United States Patent [19]

Korzenietz

[11] 4,373,728

[45] Feb. 15, 1983

[54] APPARATUS FOR RANDOM NUMBER SELECTION

[76] Inventor: Willi Korzenietz, 18-06 Parsons Blvd., Whitestone, N.Y. 11357

[21] Appl. No.: 312,644

[22] Filed: Oct. 19, 1981

[51] Int. Cl.[3] ..... A63F 5/02

[52] U.S. Cl. ..... 273/144 B

[58] Field of Search ..... 273/144 R, 144 A, 144 B, 273/142 R, 142 A, 142 C, 142 D, 142 E, 142 F, 142 G

[56] References Cited

U.S. PATENT DOCUMENTS

| | | | |
|---|---|---|---|
| 465,739 | 12/1891 | Guericke | 273/144 B |
| 2,448,151 | 8/1948 | Noel | 273/144 B |

FOREIGN PATENT DOCUMENTS

| | | | |
|---|---|---|---|
| 671125 | 2/1939 | Fed. Rep. of Germany | 273/144 A |
| 1033153 | 4/1953 | France | 273/144 A |
| 2380797 | 9/1978 | France | 273/142 E |
| 2389390 | 1/1979 | France | 273/142 E |
| 571267 | 12/1957 | Italy | 273/144 B |

*Primary Examiner*—Richard C. Pinkham
*Assistant Examiner*—Arnold W. Kramer
*Attorney, Agent, or Firm*—Michael I. Kroll

[57] ABSTRACT

Apparatus for dual random number selection is provided to pick numbers in a lottery or the like. Said invention consists of a base having a mixing reservoir, a well and a conduit between the mixing reservoir and the well, a plurality of filler and winning balls contained in the mixing reservoir, a wheel with a plurality of receptacles on its circumference each randomly numbered contained in the wall, a transparent cover over the base with the wheel's shaft through it connected to a knob to allow the wheel to rotate with each receptacle able to pick up one ball at random when placed in a vertical position.

3 Claims, 6 Drawing Figures

APPARATUS FOR RANDOM NUMBER SELECTION

BACKGROUND OF THE INVENTION

1. Field of Invention

The instant invention relates to an apparatus that is used to pick random numbers in a lottery, horse race, roulette or any number game and alike.

2. Description of the Prior Art

In the prior art if a player wnats to pick numbers at random he may randomly pick said numbers out of a hat or thinks them up in his head. There isn't any simple present day device to mechanically pick out random numbers and the instant invention is designed to perform this task.

The instant invention however offers a substantial improvement over the prior art as more fully described hereinafter.

Accordingly it is an object of this invention to provide a suitable type of apparatus for random number selection that is economical in cost, small in size and easy to use.

It is a further object of this invention to provide an apparatus that has a dual selection feature that will be more fully described hereinafter.

SUMMARY OF THE INVENTION

In the present invention the disadvantages of the prior art are overcome by providing an apparatus for random number selection that may be used to aid participants in various state lotterys to pick winning number combinations. In the New York State Lottery for example, one picks six numbers out of forty to win.

The within apparatus consists of a wheel assembly with forty randomly numbered receptacles with a reservoir to retain forty balls, six of said balls being a different color than the remaining thirty four balls. The balls are then directed into the randomly numbered receptacles and the receptacles filled with the six colored balls being the numbers that the user will have selected.

If a player uses an apparatus that has six winning balls of one color, more than thirty four filler balls of another color and a wheel having forty receptacles there is a chance some of the winning balls will not go into the receptacles and all six numbers may not be chosen.

If a player uses an apparatus that has exactly six winning balls of one color, thirty four filler balls of a different color and a wheel having forty receptacles, all the receptacles will be filled and the six numbers thus selected. A player can pick an unlimited amount of combinations of winning numbers by using the same amount of filler balls and winning balls that will match the number to receptacles on the wheel.

The instant invention has a dual random selection mode incorporated therein said dual feature comprising: (a) receptacles that are randomly numbered, said receptacles to receive winning and filler balls; and (b) forty balls comprised of winning and filler balls which are randomly diverted into (a) above.

DESCRIPTION OF THE PREFERRED EMBODIMENTS

Figure 1:
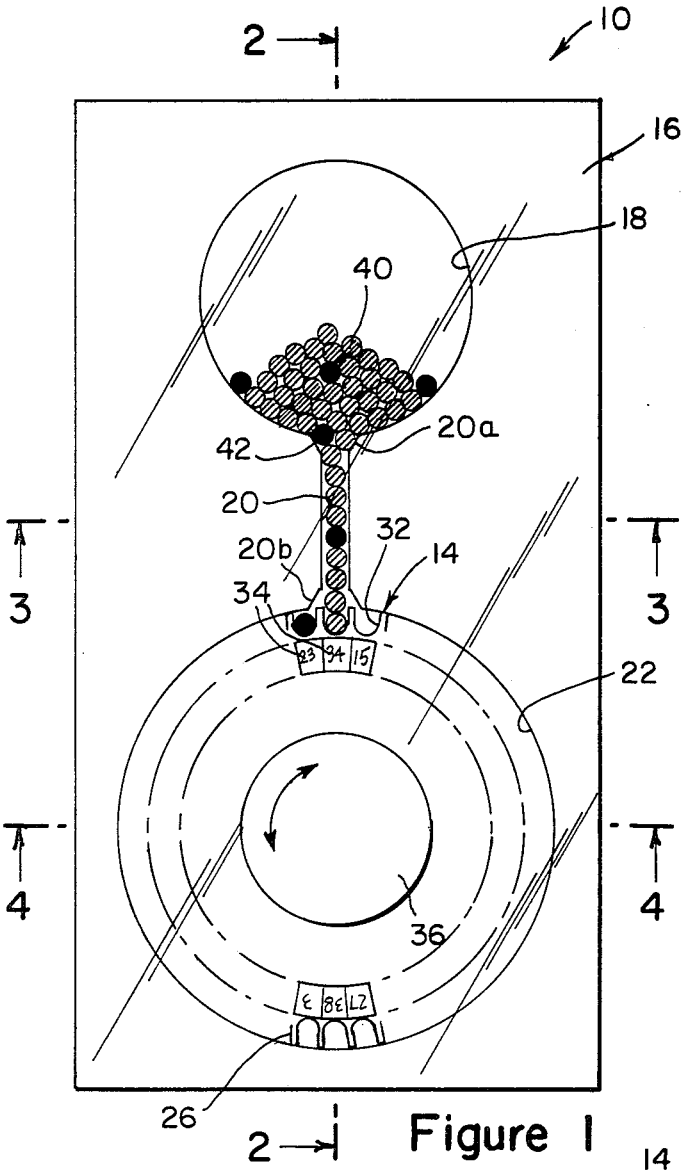
FIG. 1 of the drawing shows a plan view of the invention.
Figure 3:
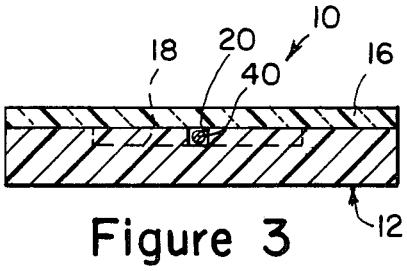
FIG. 3 of the drawing shows a cross-sectional view taken along line 3—3 in FIG. 1 of the invention.
Figure 4:
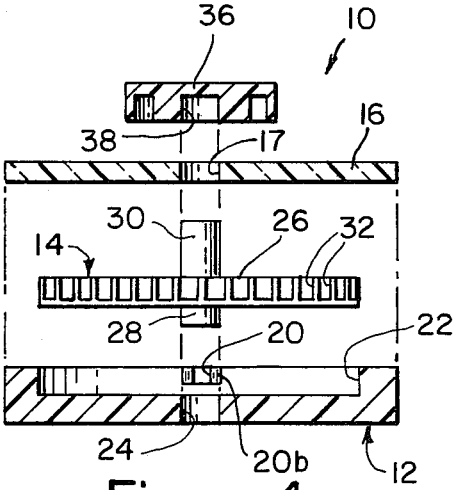
FIG. 4 of the drawing shows an exploded cross-sectional view taken along line 4—4 in FIG. 1 of the invention.
Figure 2:
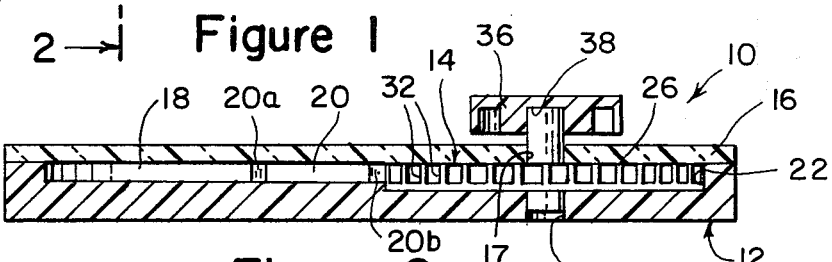
FIG. 2 of the drawing shows a cross-sectional view taken along line 2—2 in FIG. 1 of the invention.

Referring to FIGS. 1, 2, 3 and 4 of the drawing an apparatus for dual random number selection is provided generally designated 10. The apparatus 10 consists of a base 12, a plurality of filler balls 40, a plurality of winning balls 42, a wheel assembly 14, a cover 16 and a knob 36.

The base 12 has a circular mixing reservoir 18, a circular well 22 with a central aperture 24 and a conduit 20 between the mixing reservoir 18 and the well 22. The mixing reservoir 18 and conduit 20 are on the same level, but the well 22 is lower down into the base 12 to compensate for the wheel assembly 14. Bevels **20*a* are placed between the mixing reservoir 18 and conduit 20 and bevels 20*b* are placed between the conduit 20 and well 22 to facilitate the easy flow of the balls 40, 42**.

Figure 5:
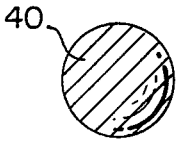
FIG. 5 of the drawing shows an enlarged view of a filler ball.
Figure 6:
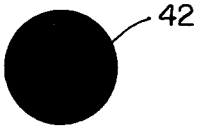
FIG. 6 of the drawing shows an enlarged view of a winning ball.

The filler balls 40 (see FIG. 5) are of one color and the winning balls 42 (see FIG. 6) are of another color. Both are stationed in the mixing reservoir 18 until needed.

The wheel assembly 14 consists of a wheel 26 with a plurality of receptacles 32 on its circumference each of which are randomly numbered 34, such as painted, printed or the like, on the top surface of the wheel 26. A lower shaft 28 is affixed to the bottom central surface of the wheel 26 and mates with the central aperture 24 in the well 22 of the base 12. The receptacles 32 are level with the conduit 20 of the base 12. An upper shaft 30 is affixed to the top central surface of the wheel 26.

The cover 16 is affixed to the base 12 by using adhesives, screws (not shown) or any other method. The cover 16 has an aperture 17 that allows the upper shaft 30 of the wheel assembly 14 to extend above the top surface of the cover 16. The cover is transparent so one can view the activity within the apparatus 10.

The knob 36 has an aperture 38 in the bottom surface that mates with the upper shaft 30 of the wheel assembly 14 whereby the wheel 26 is free to rotate in any direction between the base 12 and the cover 16.

When a player wants to choose for example six winning numbers out of forty numbers in a lottery the apparatus 10 is tilted vertically by hand with the mixing reservoir 18 in a down position. The knob 36 is then rotated clockwise or counterclockwise until all the six winning balls 42 and all the thirty four filler balls 40 are in the mixing reservoir 18. The apparatus 10 is then shaken to mix all the balls 40, 42 in the mixing reservoir 18.

The apparatus 10 is then tilted vertically in the other direction with the mixing reservoir 18 in an up position allowing the balls 40, 42 to enter the conduit 20 until either a filler ball 40 or a winning ball 42 goes into the first randomly numbered receptacle 32 that is in line with the conduit 20. The knob 36 is then either rotated clockwise or counterclockwise until all the balls 40, 42 enter all the receptacles 32 on wheel 26 so that the six winning balls 42 are located in different randomly numbered receptacles 32.

The thirty four filler balls will be in the other randomly numbered receptacles 32. The player now has six random numbers to use in the lottery.

The base 12, wheel assembly 14 and knob 36 can be made of any suitable material, such as wood, aluminum, stainless steel, plastic, etc. or any other material that will hold up in use. The cover 16 must be transparent and can be made of plastic, glass or the like.

The instant invention offers two modes for random selection of winning numbers since: (a) receptacles 32 are randomly numbered; and (b) balls 40 and 42 are randomly diverted into receptacles 32. The balls 40, 42 can be made of any suitable material such as aluminum, stainless steel or plastic with the winning balls 42 of one color and the filler balls 40 of a different color.

While the form of apparatus herein described constitutes a preferred embodiment of the invention, it is understood that the invention is not limited to this precise form of apparatus and that changes may be made therein without departing from the scope of this invention.

Having regard to the foregoing disclosure the following is claimed as the inventive and patentable embodiments thereof:

1. Apparatus for dual random number selection which comprises:

(a) a base having a mixing reservoir, a well having a central aperture and a conduit between said mixing chamber and said well;

(b) a plurality of colored filler balls stationed in said mixing reservoir in said base;

(c) a plurality of different colored winning balls stationed in said mixing reservoir in said base;

(d) a wheel assembly having a wheel with a plurality of receptacles on its circumference each of which are randomly numbered on the top surface of said wheel, a lower shaft affixed to the bottom central surface of said wheel that mates with said central aperture in said well of said base whereby said receptacles are level with said conduit of said base and an upper shaft affixed to the top central surface of said wheel;

(e) a transparent cover affixed to said base having an aperture that allows said upper shaft of said wheel assembly to extend above top surface of said cover; and (f) a knob having an aperture in the bottom surface that mates with said upper shaft of said wheel assembly whereby said wheel is free to rotate clockwise or counterclockwise between said base and said cover so each said receptacle is able to receive one said filler ball or said winning ball that travels from said mixing chamber into said conduit in said base when said apparatus is placed in a vertical position.

2. Apparatus for dual random number selection as recited in claim 1, in which said base has bevels between said mixing reservoir and said conduit to facilitate easy entry of said filler balls and winning balls from said mixing chamber into said conduit.

3. Apparatus for dual random number selection as recited in claim 2, in which said base has bevels between said conduit and said well to facilitate easy entry of said filler balls and winning balls from said conduit into said receptacles of said wheel.

* * * * *